United States Patent [19]

Freeman

[11] 4,437,957

[45] Mar. 20, 1984

[54] CATHODIC OR ANODIC PROTECTION SYSTEM AND METHOD FOR INDEPENDENTLY PROTECTING DIFFERENT REGIONS OF A STRUCTURE

[75] Inventor: Jonathan P. Freeman, Dorset, Ohio

[73] Assignee: Freeman Industries, Inc., Dorset, Ohio

[21] Appl. No.: 374,298

[22] Filed: May 3, 1982

[51] Int. Cl.[3] ..... C23F 13/00

[52] U.S. Cl. ..... 204/147; 204/196

[58] Field of Search ..... 204/147, 196

[56] References Cited

U.S. PATENT DOCUMENTS

| | | | |
|---|---|---|---|
| 2,851,413 | 9/1958 | Hosford | 204/196 |
| 3,126,328 | 3/1964 | Hutchison et al. | 204/196 |
| 3,330,751 | 7/1967 | Warner | 204/196 |
| 3,477,931 | 11/1969 | Lieda et al. | 204/196 |
| 3,556,971 | 1/1971 | Husolk | 204/196 |
| 3,600,286 | 8/1971 | Sabins | 204/149 |
| 3,674,662 | 7/1972 | Haycock | 204/147 |
| 3,841,988 | 10/1974 | Gleason | 204/196 |
| 4,080,272 | 3/1978 | Ferry et al. | 204/196 |
| 4,138,323 | 2/1979 | Statsenko et al. | 204/196 |
| 4,239,610 | 12/1980 | Severus-Laubenfeld | 204/211 |
| 4,255,242 | 3/1981 | Freeman | 204/196 |

*Primary Examiner*—T. Tung

*Attorney, Agent, or Firm*—Antonelli, Terry & Wands

[57] ABSTRACT

To protect a structure immersed in an electrolyte, at least two protection units are located adjacent to different regions of the protected structure. In a preferred embodiment, each of these protection units includes a circuit for applying rectified alternating current voltage between the structure and electrodes immersed in the electrolyte adjacent to the different regions of the structure. Also, each of the protection units includes reference cells to produce direct current voltage between the reference cells and the structure, a measuring circuit coupled to the reference cells for measuring the potential between the reference cells and the structure, and a control circuit for controlling the level of the rectified alternating current voltage at the different regions of the structure in accordance with the measured potential levels. The first and second protection units are arranged to be independent of one another so that the level of alternating current voltage applied between the different regions of the structure and the first and second protection units will be independently established. In alternative embodiments, constant current or constant voltage can be applied by the protection units rather than utilizing the reference cell feedback control.

23 Claims, 2 Drawing Figures

CATHODIC OR ANODIC PROTECTION SYSTEM AND METHOD FOR INDEPENDENTLY PROTECTING DIFFERENT REGIONS OF A STRUCTURE

FIELD OF THE INVENTION

The present invention relates generally to cathodic or anodic protection systems and methods, and, more particularly, to a system and method for providing independent protection to different regions of a protected structure.

BACKGROUND OF THE INVENTION

As is well known, metal structures which must be immersed in electrolytes, such as iron or iron alloys in water, are subject to a significant problem of corrosion. This problem occurs due to the flow of local current through the electrolyte between localized cathodic and anodic portions of the immersed structure.

Accordingly, in the past, a number of systems have been developed to counteract this corrosion by making the metal structure to be protected part of an electrical arrangement which holds the structure at a predetermined electrical potential. This is accomplished by providing an electrode which is also immersed in the electrolyte and spaced apart from the structure to be protected. The structure and the electrode are then coupled to terminals of differing potentials of a direct current voltage source (typically a rectified alternating current voltage). Thus, the structure forms part of a circuit comprised of the voltage source, the electrode, the electrolyte, and the structure itself. This provides a predetermined polarity of potential to the structure to reduce the likelihood of the development of corrosion produced by local current flow.

If the structure is maintained at a negative potential, the system is known as a cathodic protection system. On the other hand, if the structure is maintained at a positive potential, the system is known as an anodic protection system. Of course, in either case, the electrode will have a polarity opposite to that of the structure. Further, in either case, it is desirable to maintain the structure at a predetermined potential to continue to prevent corrosion, since an improper potential level can reduce the effectiveness of corrosion prevention, and, in some cases, actually stimulate the corrosion.

For illustrative purposes, all discussion hereinafter will relate to a cathodic protection system wherein the structure to be protected is a cathode, and the electrode with which it cooperates is an anode. Of course, it is understood that the system discussed herein can readily be converted to an anodic protection system by reversing the polarities of the structure and the electrode.

To hold the structure at a desired potential level, e.g., at a predetermined negative potential for cathodic protection, it is necessary to sense the potential of the structure and make any changes necessary to the rectified alternating current source for correcting the current flow between the cathode and the anode to maintain the desired potential level. Typically, the sensing is done through the use of a reference cell (e.g., a standard Cu-$CuSO_4$ half cell) which is also located in the electrolyte spaced apart from the structure. This reference cell is coupled to a measuring means such as a voltmeter. The measuring means is also coupled to the structure. Therefore, the measuring means can readily determine the potential of the structure. Since it is known that the potential of the structure has to remain at a certain level to be effective to prevent corrosion, the determination of the structure's potential allows control of the voltage applied between the anode and the structure which establishes the potential of the structure. Such control can be manual, or with an automatic adjuster for the rectified alternating current source coupled to the anode and cathode.

Although some prior art systems such as U.S. Pat. No. 4,080,272 issued to Ferry et al show the use of a plurality of anodes in a single protected tank, it is standard to use a single reference cell and a single control system for controlling the voltage applied to all of these anodes. Thus, the actual voltage applied depends on the measurement of potential at a single point of the protected structure. Although this is sometimes quite adequate, the inventor has found that in certain situations it results in significant problems.

For example, in water tanks, the upper portion of the tank (e.g. the upper bowl portion) is subject to greater coating damage due to winter ice formations than the lower portion (e.g., the riser or lower bowl portion). In conventional systems, if the reference cell for the anodes is located in the upper portion, the level of the applied rectified alternating current voltage is high to account for the measurements taken by the reference cell due to the above-mentioned ice formations. However, this same level of rectified alternating current voltage is also applied to the lower anodes in the riser portion even though the lower portion is not subject to the same large number of ice formations. Thus, the rectified alternating current voltage is excessive for the lower riser portion. This wastes electricity, and, in some cases, the excessive current provided in the riser portion can actually lead to coating disbonding.

On the other hand, if the reference cell were to be located in the lower portion of the tank structure, the extra current necessary in the upper tank portion due to the above-mentioned problem is not provided since the reference cell will not sense the need for it. Therefore, the degree of protection achieved at the upper level will, in some cases, be insufficient.

Another disadvantage of using only a single reference cell and control system is that the entire protection of the tank structure depends on these units. If any fault occurs in either the reference cell, rectifier, or the control circuitry, the tank protection will be completely lost.

Some attempts have been made in the past to overcome the above difficulties by inserting variable resistors in the separate anode feed cables to allow some manual adjustment of current flow to various portions of the structure. This method has been somewhat successful in cases of elevated water tanks with wet risers. The rectifier directly provides DC current to the tank bowl anodes, while a secondary circuit using a variable or fixed resistor connected to the rectifier limits the current to the riser anodes. However, this method cannot effectively compensate for changes in all parameters governing the protective current densities, and is not automatic. Also, the resistors are power consuming devices which serve to lower the system's efficiency.

SUMMARY OF THE INVENTION

Accordingly, it is an object of the present invention to provide an improved system and method for anodic or cathodic protection of a structure.

It is a further object of the present invention to provide an improved system and method for providing different independent protection levels to different regions of a protected structure.

Another object of the present invention is to provide an improved system and method for providing different independent protection levels to different regions of a protected structure continuously and simultaneously.

To achieve these and other objects, the present invention provides a system and a method for protecting a structure immersed in an electrolyte using at least two protection units located adjacent to different regions of the protected structure. Each of these protection units includes means for applying rectified alternating current voltage between the structure and electrodes immersed in the electrolyte adjacent to the different regions of the structure. Also, each of the protection units includes reference cells to produce direct current voltage between the reference cells and the structure, measuring means coupled to the reference cells for measuring the potential between the reference cells and the structure, and control means for controlling the level of the rectified alternating current voltage at the different regions of the structure in accordance with the measured potential levels. The first and second protection units are arranged to be independent of one another so that the level of alternating current voltage applied between the different regions of the structure and the first and second protection units will be independently established.

DETAILED DESCRIPTION

Figure 1:
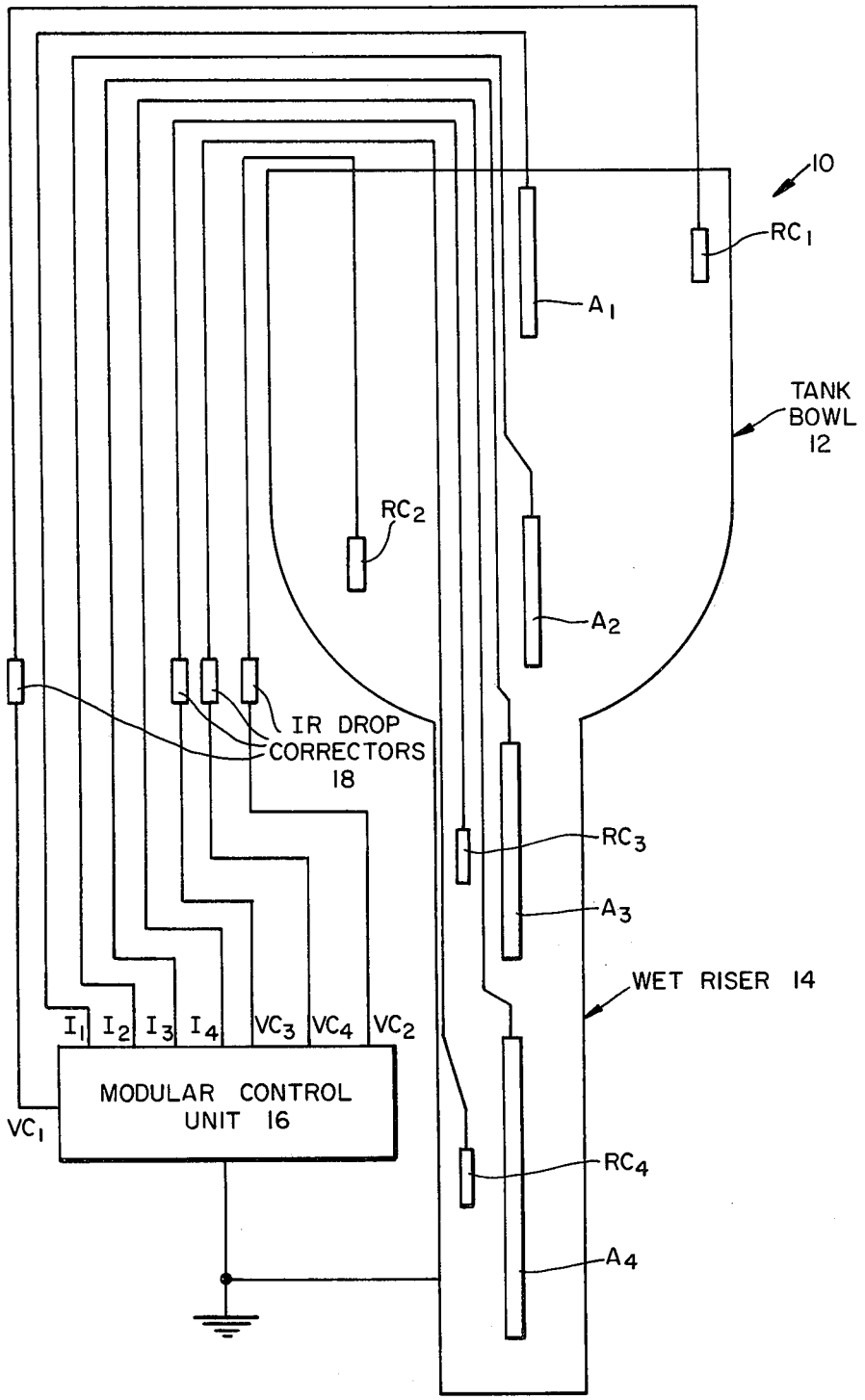

Referring now to the drawings, FIG. 1 shows a basic cathodic protection arrangement in accordance with the present invention using a water tank 10 having a tank bowl 12 and a riser 14. Within the water tank 10, a plurality of anodes $A_1$, $A_2$, $A_3$, and $A_4$ are provided along with a plurality of reference cells $RC_1$, $RC_2$, $RC_3$, and $RC_4$. Specifically, the anodes $A_1$–$A_4$ and the reference cells $RC_1$–$RC_4$ are formed in four groups of $A_1$–$RC_1$, $A_2$–$RC_2$, $A_3$–$RC_3$, and $A_4$–$RC_4$ at different levels in the tank with the first two groups being located in the tank bowl 12 while the other two groups are located in the wet riser 14. It should be noted that other tank configurations could be used.

The anodes are connected to a modular control unit 16 to receive current and voltage therefrom as will be discussed hereinafter. The reference cells are also connected to the modular control unit 16. However, this connection is preferably made through an IR drop correction circuit as discussed in U.S. Pat. No. 4,255,242 issued on Mar. 10, 1981 to the inventor of the present invention. This U.S. Pat. No. 4,255,242 is hereby incorporated by reference.

Figure 2:
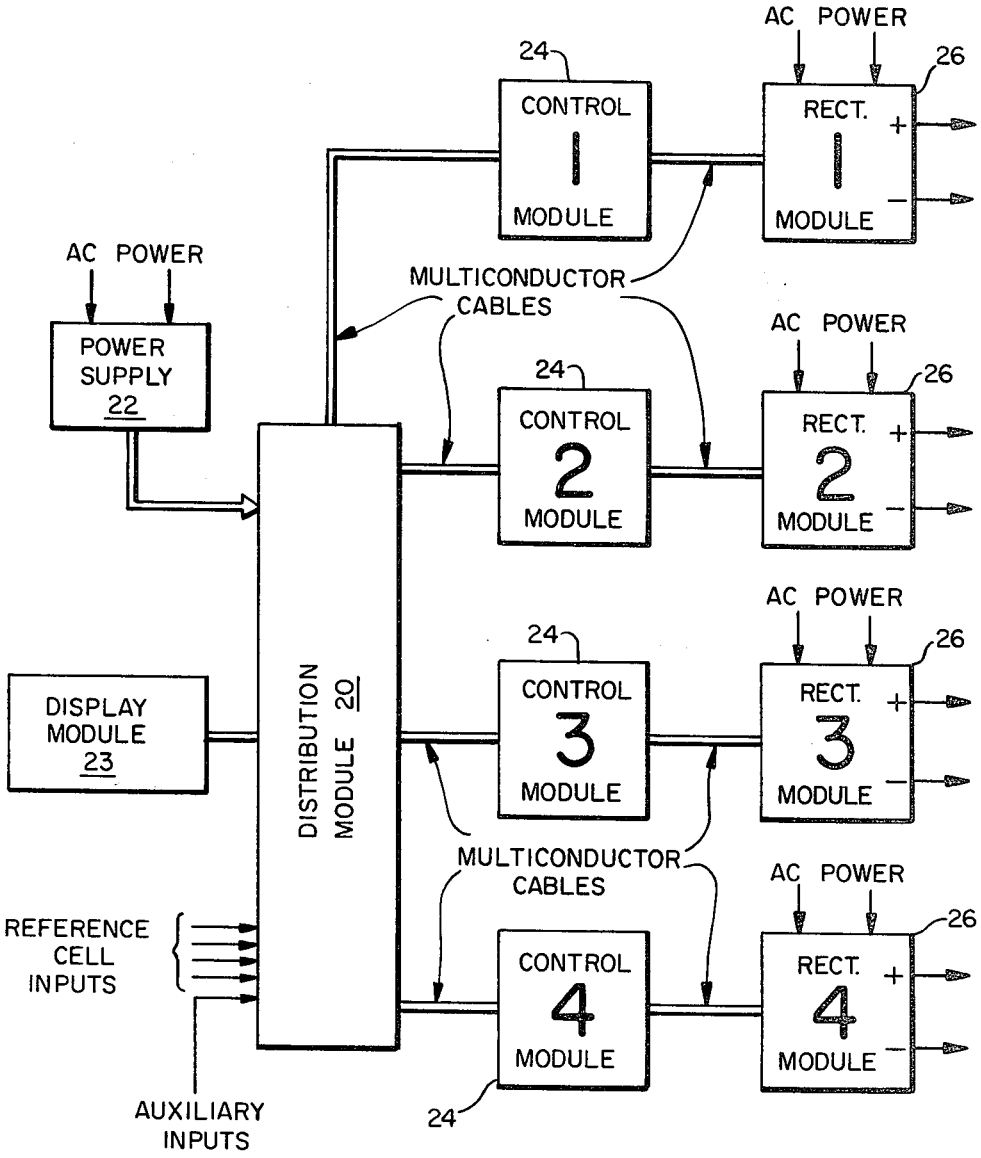

FIG. 2 shows the structure of a preferred embodiment of the modular control unit 16.

Specifically, the modular control unit 16 comprises a distribution module 20 having an input from a power supply 22 which is coupled to receive AC power and convert it to a desired current and voltage at appropriate levels. The distribution module 20 also is coupled to receive the outputs of the reference cell potentials (preferably after they have passed through the IR drop correction circuit 18) as well as auxiliary control inputs if desired (e.g., for constant voltage or constant current control as will be discussed hereinafter). Further, the distribution module is coupled to a display module 23 and to each of a plurality of control modules 24. These control modules are, in turn, coupled to a plurality of rectifier modules 26.

When operating as a cathodic protection system such as shown in FIG. 1, each rectifier module 26 is independently coupled to one of the anodes $A_1$–$A_4$. Each rectifier module 26 is also coupled to a source of AC power which either will be individually applied from a separate source to each rectifier or applied in common from a common AC source.

As shown in FIG. 2, each of the rectifier modules preferably has both a positive and a negative rectified output terminal. In the cathodic protection arrangement, the positive output terminals of each of the rectifier modules will be coupled to one of the anodes $A_1$–$A_4$ so that a positive rectified AC wave will be applied across the anode in a conventional manner. However, since a negative output terminal is also provided, the modular control unit 16 can readily be switched to an anodic protection format simply by using the negative output of the rectifiers to couple to the cathodes in a protective system.

Although not necessarily restricted thereto, it should be noted that the modular control unit 16 is preferably contained in a single sealed cabinet made of a material which can protect the circuit elements from the environment. For example, a sealed stainless steel cabinet is quite appropriate for this purpose. This cabinet can readily house a desired number of the individual control modules 24 and the rectifier modules 26 to permit convenient control of all levels of the protected structure from a single control location.

The control modules 24 serve to communicate with the rectifier modules 26 to individually control the voltage and current of the rectifier modules 26 in a manner discussed below. On the other hand, the distribution module 20 serves as a coupling network to couple the respective control modules 24 to receive individual reference cell output signals, to couple the control modules together, if desired, to provide distributed power to the control modules, and to couple the output signals from the control modules to a display module 23 if a display of the respective states of each control module (and, accordingly, each anode), is desired. As such, this distribution module 20 is preferably a solid-state switching circuit which can be readily designed in accordance with known switching principles to provide the respective couplings noted above.

In the preferred potential control mode embodiment of the present invention, the actual potentials between the reference cells $RC_1$–$RC_4$ and the tank structure 10 at each point are measured by the IR drop correction circuits 18 in the manner set forth in U.S. Pat. No. 4,255,242. Thus, each IR drop correction circuit 18 serves as a measuring circuit which includes means for separating any voltage component of the rectified alternating current at the reference cell from the direct current voltage produced by the reference cell. The IR drop correction circuit 18 also includes an output circuit for providing an output voltage having only the cell-to-structure potential to indicate the potential of the structure to be protected without interference from the alternating current rectified voltage. The details of this arrangement are set forth at length in the above-mentioned U.S. Pat. No. 4,255,242.

Accordingly, it is preferred in the present invention that the reference cell potential signals applied to the distribution module are the outputs of the individual IR drop correction circuits 18. These outputs represent the potential between the reference cell and the tank structure, and are fed by the distribution module to the individual respective control modules 24 in accordance with the switching logic set into the distribution module 20. However, it should be noted that the present invention is not limited to requiring the IR drop correction circuit 18, and could operate with a simple direct measured potential from each individual reference cell if desired.

The control modules 24 themselves operate in a manner similar to that discussed in U.S. Pat. No. 4,255,242 for comparison of the received potential from the reference cells with a predetermined DC reference potential level. The DC reference level can be provided individually within each control module or in common through the distribution module if desired. In either case, the comparison within the control modules 24 serves to generate error signals based on the difference between the received reference cell potentials and the DC reference levels. These error signals are then used to individually control the current and voltage applied to each of the respective anodes through the rectifier modules 26 in accordance with basic feeback control principles.

Although the above discussion relates to the preferred embodiment of the present invention using a plurality of reference cells to monitor a reference potential, it should be noted that the present invention could operate in a constant current mode or a constant voltage mode to control each of the anodes without the need of the reference cells if desired. In such an arrangement, each of the anodes would be provided with either a constant current or a constant voltage from the rectifier modules 26 under the control of the control modules 24. As such, the constant current or constant voltage sources could be provided individually in each of the control modules 24. Alternatively, the constant current or constant voltage could be provided by a common constant current source or constant voltage source from, for example, the power supply 22. This would be coupled to the individual control modules 24 through the distribution module 20. In this case, each of the control modules 24 would include a control circuit designed in accordance with known principles to control the level of the applied current or voltage in accordance with values predetermined for each of the control modules.

These constant current or constant voltage arrangements would still permit independent control of the rectifiers since they could be set at different levels of independent current or voltage. Thus, large amounts of protective current or voltage could be provided where necessary (e.g., at the water line in the tank bowl as discussed earlier) while smaller amounts of constant current or voltage could be provided at different lower levels of the tank.

The determination of whether the system is to operate in a potential mode (i.e., using the reference cells), a constant current mode, or a constant voltage mode, could be done either by appropriate switches utilized in the control modules 24 or by control through the distribution module 20 using the auxiliary inputs thereto. It is one of the features of the present invention that a standard modular control unit can be made which, simply by suitable switching, can be used for any one of the three modes of potential control, constant current control, or constant voltage control. This greatly enhances the versatility of the system since the modular control unit can be utilized in the manner which is most appropriate for the particular protection necessary. Including using different protection modes for different levels.

As can be seen from the above description, the present invention permits effectively subdividing the structure being protected into small or more distinct areas which are more homogeneous and have fewer geometric asymmetric areas than the entire tank. Each independent automatic cathodic protection system thus provides primary protection for the smaller area with greater accuracy, while, at the same time, providing some secondary protection for far-removed areas. This means that reliability of the system is improved because, even if one of the protection units fails, the others will continue to provide at least partial protection to the structure. Further, because excessive current and voltage are not applied in areas where they are not necessary, power consumption is reduced. Finally, it should be noted that this protection arrangement can be carried out continuously and simultaneously with all of the anodes operating together even though these anodes may be at different levels of current or voltage. Thus, continuous protection of all levels of the tank is achieved.

It is to be understood that the above-described arrangements are simply illustrative of the application of the principles of this invention. Numerous other arrangements may be readily devised by those skilled in the art which embody the principles of the invention and fall within its spirit and scope.

Although indicated in FIG. 1 as single anodes, anodes $A_1$–$A_4$ could each be multiple anode configurations.

I claim:

1. A system for protecting a structure immersed in an electrolyte using at least two protection units located adjacent to different regions of the structure comprising:

a first protection unit comprising:

first means for applying a continuously adjustable rectified alternating current voltage between the structure and at least a first electrode which is immersed in the electrolyte and spaced apart from the structure;

a first reference cell located in the electrolyte to produce a direct current voltage between the first reference cell and the structure;

first measuring means coupled to the first reference cell to measure the potential between the first reference cell and the structure; and first control means coupled between said first measuring means and said first applying means for continuously adjusting said first applying means to control the level of the rectified alternating current voltage applied by said first applying means in accordance with the level of the potential measured by said first measuring means; and a second protection unit comprising:

second means for applying a continuously adjustable rectified alternating current voltage between the structure and at least a second electrode which is immersed in the electrolyte and spaced apart from the structure;

a second reference cell located in the electrolyte to produce a direct current voltage between the second reference cell and the structure;

second measuring means coupled to said second reference cell to measure the potential between said second reference cell and the structure; and second control means coupled between said second measuring means and said second applying means for continuously adjusting said second applying means to control the level of the rectified alternating current voltage applied by said applying means in accordance with the level of potential measured by said second measuring means, wherein the first and second protection units are essentially independent of one another in their operation and are located adjacent to different regions of the protected structure so that the level of alternating current voltage applied between the structure and the first electrode and the structure and the second electrode will be independently established by the first and second control means in accordance with the respective potentials measured by said first and second measuring means.

2. A system according to claim 1, wherein the rectified alternating current voltages are applied so that the first and second electrodes are positive with respect to the structure so that the first and second electrodes are anodes and the structure is a cathode.

3. A system according to claim 1, wherein the rectified alternating current voltages are applied so that the first and second electrodes are negative with respect to the structure so that the first and second electrodes are cathodes and the structure is an anode.

4. A system according to claim 1, 2 or 3, wherein the structure comprises a tank having a tank bowl and a riser, and further wherein the first protection system is located in the tank bowl and the second protection system is located in the riser.

5. A system according to claim 1, 2 or 3, wherein the first and second measuring means include means to separate out any alternating current voltage component of the rectified alternating current voltages induced at the respective first and second reference cells by current flowing between the first and second electrodes and the structure from direct current voltage components produced by the first and second reference cells between the reference cells and the structure, and output means to provide only the direct current voltage components as the output of said measuring means to indicate the potential of the structure to be protected without interference from a voltage produced by the current flow between the electrode and the structure.

6. A system according to claim 1, wherein the first and second control means and the first and second measuring means are located in common in a single control cabinet adjacent to the protected structure.

7. A system according to claim 6, wherein the control cabinet is made of stainless steel.

8. A system according to claim 1, 2 or 3, wherein the first and second protection systems operate to respectively apply the rectified first and second alternating current voltages simultaneously and continuously to the first and second electrodes.

9. A system according to claim 1, wherein the first protection unit further comprises first means for applying a first constant voltage between the structure and the first electrode and first means for applying a first constant current to the first electrode, and wherein the second protection unit further comprises second means for applying a second constant voltage between the structure and the second electrode and second means for applying a second constant current to the second electrode, wherein the levels of the first and second constant voltages and currents are independently established according to predetermined values, and wherein the first protection unit further includes means for selecting one of the first applying means for connection to the first electrode and the second protection unit further includes means for selecting one of the second applying means for connection to the second electrode.

10. A cathodic protection system for protecting a tank structure including a bowl portion and a riser portion for containing an electrolyte using at least two protection units located adjacent to different regions of the tank structure comprising:

a first protection unit located in the bowl portion comprising:

first means for applying a continuously adjustable rectified alternating current voltage between the structure and at least a first positive electrode which is immersed in the electrolyte and spaced apart from the bowl portion;

a first reference cell located in the electrolyte adjacent to said bowl portion to produce a direct current voltage between the first reference cell and the bowl portion;

first measuring means coupled to the first reference cell to measure the potential between the first reference cell and the bowl portion; and first control means coupled between said first measuring means and said first applying means for continuously adjusting said first applying means to control the level of the rectified alternating current voltage applied by said first applying means in accordance with the level of the potential measured by said first measuring means; and a second protection unit located in the riser portion comprising:

second means for applying a continuously adjustable rectified alternating current voltage between the structure and at least a second positive electrode which is immersed in the electrolyte and spaced apart from the riser portion;

a second reference cell located in the electrolyte adjacent to said riser portion to produce a direct current voltage between the second reference cell and the riser portion;

second measuring means coupled to said second reference cell to measure the potential between said second reference cell and the riser portion; and second control means coupled between said second measuring means and said second applying means for continuously adjusting said second applying means to control the level of the rectified alternating current voltage applied by said applying means in accordance with the level of potential measured by said second measuring means, wherein the first and second protection units are essentially independent of one another in their operation and are operated continuously and simultaneously so that the level of alternating current voltage applied between the bowl portion and the first electrode and the riser and the second electrode will be independently established by the first and second control means in accordance with the respective potentials measured by said first and second measuring means.

11. A method for protecting a structure immersed in an electrolyte by separately protecting at least two different regions of the structure comprising:

protecting a first area of the structure by the steps of:

applying a first continuously adjustable rectified alternating current voltage between the structure and at least a first electrode which is immersed in the electrolyte and spaced apart from the structure;

producing a first direct current voltage between the structure and a first reference cell located in the electrolyte;

measuring the potential between the first reference cell and the structure; and adjusting the level of the first rectified alternating current voltage in accordance with the level of the measured potential between the first reference cell and the structure; and protecting a second area of the structure by the steps of:

applying a second continuously adjustable rectified alternating current voltage between the structure and at least a second electrode which is immersed in the electrolyte and spaced apart from the structure;

producing a second direct current voltage between the structure and a second reference cell located in the electrolyte;

measuring the potential between said second reference cell and the structure; and adjusting the level of the second rectified alternating current voltage in accordance with the level of the measured potential between the second reference cell and the structure, wherein the steps of protecting first and second areas of the structure are carried out essentially independently of one another so that the level of alternating current voltage applied between the structure and the first electrode and the structure and the second electrode will be independently established in accordance with the respective measured potentials between the first and second reference cells and the structure.

12. A method according to claim 9, wherein the rectified alternating current voltages are applied so that the first and second electrodes are positive with respect to the structure to form a cathodic protection system.

13. A method according to claim 9, wherein the rectified alternating current voltages are applied so that the first and second electrodes are negative with respect to the structure to form an anodic protection system.

14. A method according to claim 9, 12 or 13, wherein the protected structure comprises a tank having a tank bowl and a riser wherein the first protected area of the structure is located in the tank bowl and the second protected area of the structure is located in the riser.

15. A method according to claim 9, wherein the steps of measuring the potentials and adjusting the rectified alternating current voltage levels comprise:

sensing any alternating current voltage components produced at the respective reference cells by the rectified alternating current flows in the direct current components produced by the respective reference cells;

separating the alternating current voltage components produced by the rectified alternating currents from the direct current voltage components; and providing output signals comprising only the direct current voltage components.

16. A method according to claim 11, 12 or 13, wherein the first and second alternating current voltages are respectively applied simultaneously and continuously to the first and second electrodes.

17. A cathodic protection method for protecting a tank structure including a bowl portion and a riser portion for containing an electrolyte by separately protecting the bowl portion and the riser portion of the structure comprising:

protecting the bowl portion of the tank structure by the steps of:

applying a first continuously adjustable rectified alternating current voltage between the bowl portion and at least a first positive electrode which is immersed in the electrolyte and spaced apart from the bowl portion;

producing a first direct current voltage between the bowl portion and a first reference cell located in the electrolyte adjacent to said bowl portion;

measuring the potential between the first reference cell and the bowl portion; and adjusting the level of the first rectified alternating current voltage applied by said first applying means in accordance with the level of the measured potential between the first reference cell and the bowl portion; and protecting the riser portion of the tank structure by the steps of:

applying a second continuously adjustable rectified alternating current voltage between the riser portion and at least a second electrode which is immersed in the electrolyte and spaced apart from the riser portion;

producing a second direct current voltage between the riser portion and a second reference cell located in the electrolyte adjacent to said riser portion;

measuring the potential between said second reference cell and the riser portion; and adjusting the level of the second rectified alternating current voltage applied by said applying means in accordance with the level of the measured potential between the second reference cell and the riser portion, wherein the steps of protecting first and second areas of the structure are carried out essentially independently of one another continuously and simultaneously so that the level of alternating current voltage applied between the bowl portion and the first electrode and the riser portion and the second electrode will be independently established in accordance with the respective measured potentials between the first and second reference cells and the bowl and riser portions of the tank structure.

18. A system for protecting a structure immersed in an electrolyte using at least two protection units located adjacent to different regions of the structure comprising:

a first protection unit comprising:

first means for applying a first constant voltage between the structure and a first electrode which is immersed in the electrolyte and spaced apart from the structure; and a second protection unit comprising:

second means for applying a second constant voltage between the structure and a second electrode which is immersed in the electrolyte and spaced apart from the structure, wherein the first and second protection units are essentially independent of one another in their operation and are located adjacent to different regions of the protected structure so that the level of the first and second constant voltages applied between the structure and the first electrode and the structure and the second electrode will be independently established in accordance with predetermined values.

19. A system according to claim 18, wherein the first and second constant voltages are applied so that the first and second electrodes are positive with respect to the structure so that the first and second electrodes are anodes and the structure is a cathode.

20. A system according to claim 18, wherein the first and second constant voltages are applied so that the first and second electrodes are negative with respect to the structure so that the first and second electrodes are cathodes and the structure is an anode.

21. A system for protecting a structure immersed in an electrolyte using at least two protection units located adjacent to different regions of the structure comprising:

a first protection unit comprising:

first means for applying a first constant current to at least a first electrode which is immersed in the electrolyte and spaced apart from the structure; and a second protection unit comprising:

second means for applying a second constant current to at least a second electrode which is immersed in the electrolyte and spaced apart from the structure, wherein the first and second protection units are essentially independent of one another in their operation and are located adjacent to different regions of the protected structure so that the level of the first and second constant currents applied to the first electrode and the second electrode will be independently established in accordance with predetermined values.

22. A system according to claim 21, wherein the first and second constant currents are applied so that the first and second electrodes are positive with respect to the structure so that the first and second electrodes are anodes and the structure is a cathode.

23. A system according to claim 21, wherein the first and second constant currents are applied so that the first and second electrodes are negative with respect to the structure so that the first and second electrodes are cathodes and the structure is an anode.

* * * * *